US006742685B2

(12) United States Patent
Williams

(10) Patent No.: US 6,742,685 B2
(45) Date of Patent: Jun. 1, 2004

(54) CLIP AND HOLDER FOR PORTABLE DEVICES

(76) Inventor: Thomas Williams, 49 Kenneth St., W. Roxbury, MA (US) 02132

( * ) Notice: Subject to any disclaimer, the term of this patent is extended or adjusted under 35 U.S.C. 154(b) by 128 days.

(21) Appl. No.: 10/038,708

(22) Filed: Jan. 4, 2002

(65) Prior Publication Data

US 2003/0127477 A1 Jul. 10, 2003

(51) Int. Cl.[7] ..... A45F 5/00; A44B 21/00; B65D 25/52; A01K 97/04; A01K 97/06

(52) U.S. Cl. ..... 224/197; 224/269; 24/3.7

(58) Field of Search ..... 24/3.7, 3.12; 224/195, 224/666, 668, 268, 269, 272, 197, 904, 907, 929, 930

(56) References Cited

U.S. PATENT DOCUMENTS

| | | | | | |
|---|---|---|---|---|---|
| 520,053 | A | * | 5/1894 | Hopkins | 224/182 |
| 1,364,195 | A | * | 1/1921 | Harrer | 24/3.12 |
| 2,399,522 | A | * | 4/1946 | Tyson | 224/197 |
| 3,212,688 | A | * | 10/1965 | Lane | 224/247 |
| 3,659,759 | A | * | 5/1972 | Walton | 224/666 |
| 4,638,530 | A | * | 1/1987 | Perry | 24/3.12 |
| 4,708,273 | A | * | 11/1987 | Grant | 224/148.6 |
| 5,351,868 | A | * | 10/1994 | Beletsky et al. | 224/245 |
| 5,540,367 | A | * | 7/1996 | Kauker | 224/269 |
| 5,983,686 | A | * | 11/1999 | Lee | 70/456 R |
| 6,029,871 | A | * | 2/2000 | Park | 224/197 |
| 6,045,017 | A | * | 4/2000 | Connell | 224/148.7 |
| 6,176,401 | B1 | * | 1/2001 | Lim | 224/196 |
| 6,311,881 | B1 | * | 11/2001 | Kamaiya | 224/195 |
| 6,318,610 | B1 | * | 11/2001 | Doherty | 224/271 |
| 6,367,672 | B1 | * | 4/2002 | Lind | 224/245 |
| 6,454,147 | B1 | * | 9/2002 | Marks | 224/268 |

OTHER PUBLICATIONS

L.L.Bean Outdoors Winter 2001 Catalog (selected pages).

* cited by examiner

*Primary Examiner*—Sue A. Weaver
(74) *Attorney, Agent, or Firm*—Fish & Richardson P.C.

(57) ABSTRACT

The present invention provides a belt hanger clip and cell phone holder. The belt hanger clip includes a belt clip that slips over the belt or other article of clothing. A loop is rigidly fastened to the exterior of the belt clip portion. A cell phone holder has a cradle portion that securely holds a cell phone within a semi-rigid, plastic frame. A carabiner style clip protrudes from the side of the cradle portion. The cell phone holder assembly allows the users to quickly and easily connect the cell phone holder latch against the loop of the belt clip hanger for quick and secure storage.

13 Claims, 4 Drawing Sheets

CLIP AND HOLDER FOR PORTABLE DEVICES

BACKGROUND

This invention relates to a holder assembly for a portable device, and more particularly to a holder for a cellular phone.

Many cellular phone holders include a tension clip and a pocket that a cellular phone fits into. The user either clips the holder on their belt or their hip pocket. Such a cellular phone holder resembles an eyeglasses case. The clip is mounted on the back of the case and is tension-loaded during manufacturing. The clip has a double curve made out of steel or other springy material.

SUMMARY

The details of one or more embodiments of the invention are set forth in the accompanying drawings and the description below. Other features, objects, and advantages of the invention will be apparent from the description and drawings, and from the claims.

DETAILED DESCRIPTION

Figure 1:
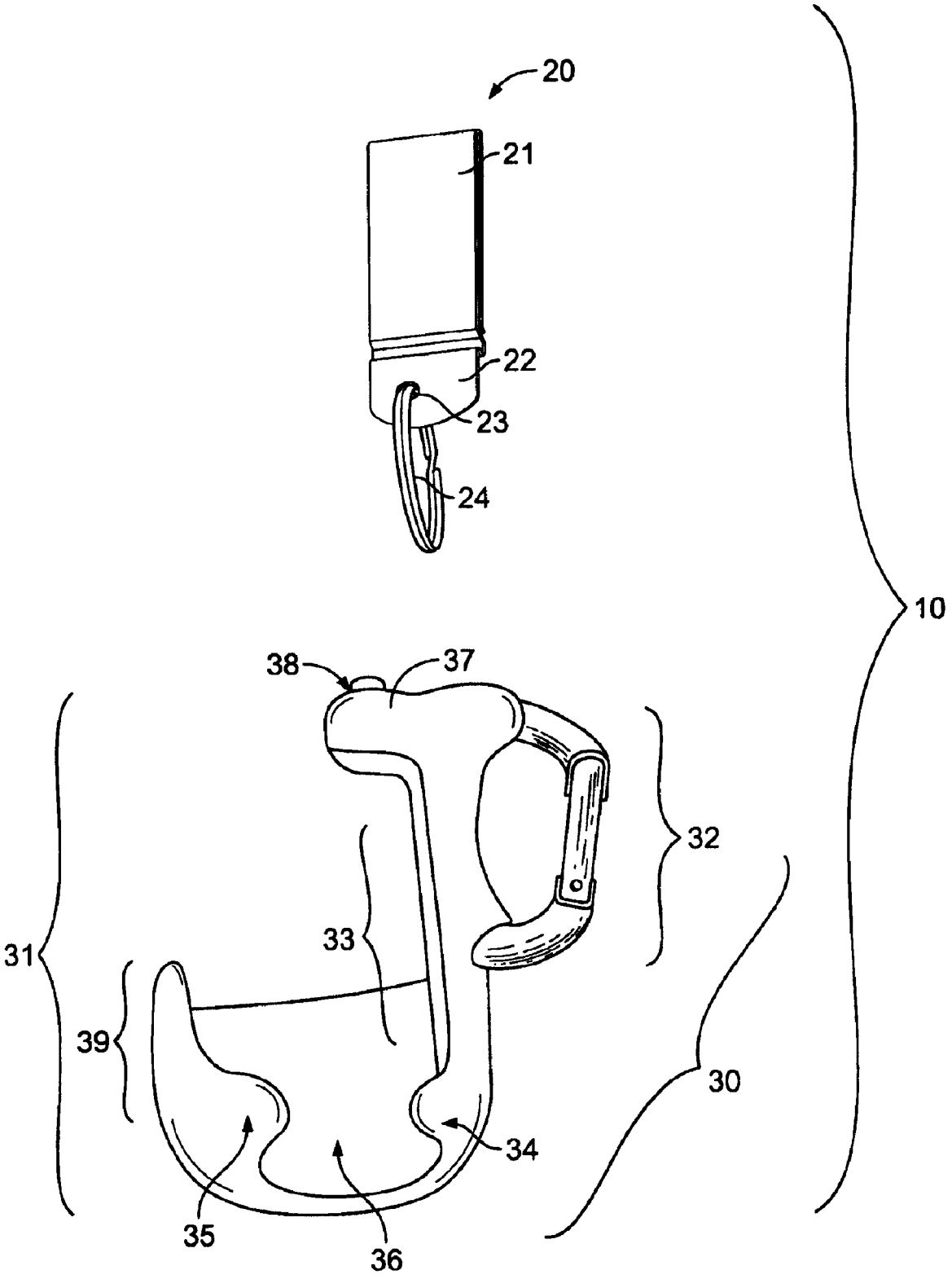
FIG. 1 is a plan view of individual components of a holder assembly.

Referring to FIG. 1, a cell phone holder assembly 10 includes a belt hanger clip 20 and cell phone holder 30. The belt hanger clip 20 includes a belt clip 21 that slips over a belt or other article of clothing of a user. A loop 24 is rigidly fastened to a bottom portion 22 of the belt clip 21. The cell phone holder 30 includes a cradle portion 31 that securely holds a cell phone within a semi-rigid plastic frame. A carabiner style latch 32 supports and connects from a side of the cradle portion. The latch 32, in this embodiment, is a spring-loaded carabiner clip. The cell phone holder 30 allows the user to quickly and easily slap the cell phone holder latch 32 against the loop 24 of the belt hanger clip 20 for secure storage. The user is aware of the cell phone location by the gentle tapping of the cell phone holder 30 against the user's hip without the discomfort of many holders that tightly secure the cell phone on the hip. Furthermore note that belt hanger clip 20 and cradle 31 are such that the cell phone holder assembly 10 with the cell phone attached rests in a position that is comfortable for the user and retrieval and attachment of the phone is convenient independent of body position (e.g. sitting, standing). The details of the positioning are given below. This is in contrast to other potential attachment points for cradle 31 like a belt itself or a belt loop on a pair of pants. In each of these cases, both resting position of the attached assembly or the act of attachment or retrieval may be uncomfortable or inconvenient.

The cradle 31 includes a column 33 where on an upper part of the column 33 is a member 37 having a hole deposed

38 there through. The hole is provided to accept an antenna stalk of a cell phone. A bottom portion of the column 33 supports a back 36 and two lower members 34 and 35 that form part of the back and which are used to support the bottom of the phone. The lower members 34 and 35 are curved members that retain the cell phone in the cell phone holder 30. Member 35 is made somewhat flexible whereas lower member 34 is made of a more rigid material to provide flexion for the holder. Part of the flexion also comes from the back member 36. The lower member 34 and 35 together with the back act to secure the cell phone with in the cell phone holder 30. A tension characteristic of the material can add additional support for the cell phone. The cradle 31 also includes a sidewall 39 somewhat curved, or another short column, which is coupled to the other side of the back 36 opposite from column 33 and has a small shelf portion to help secure the phone in the cradle 31. The exact dimensions and configurations of the cradle 31 are selected to conform to the shape of the user's cell phone. One embodiment of the holder assembly would provide many different shaped cradles, each one is customized to the many different styles of cell phone currently sold. Furthermore, a large range of cell phone accessories exist. Further embodiments provide cradles designed to hold the cell phone and its accessory. For example, a common such accessory is a leather cover used to protect the cell phone. A cradle designed to hold the cell phone while the leather cover is on the phone maintains the advantageous functionality of the cover while also maintaining the functionality of the cradle. A variety of cradles would be manufactured allowing a user to interchangeably use the belt hanger clip 20 with a variety of cell phone holders 30. Furthermore, by design it is possible to remove the cell phone from holder 30 when needed. Cell phone adapters for various purposes exist. For example, hands-free cell phone adapters allow for safer use of cell phones while driving. Many of these adapters may be designed for use with the cell phone itself and may not accommodate cradle 31. Since the cell phone can be removed when necessary the functionality of these adapters and the cradle 31 are preserved.

The cradle 31 can be produced from a strong, semi-flexible, molded plastic. However, other materials with similar characteristics can be used in place of a plastic material. Examples includes hard rubbers, etc.

Figure 2:
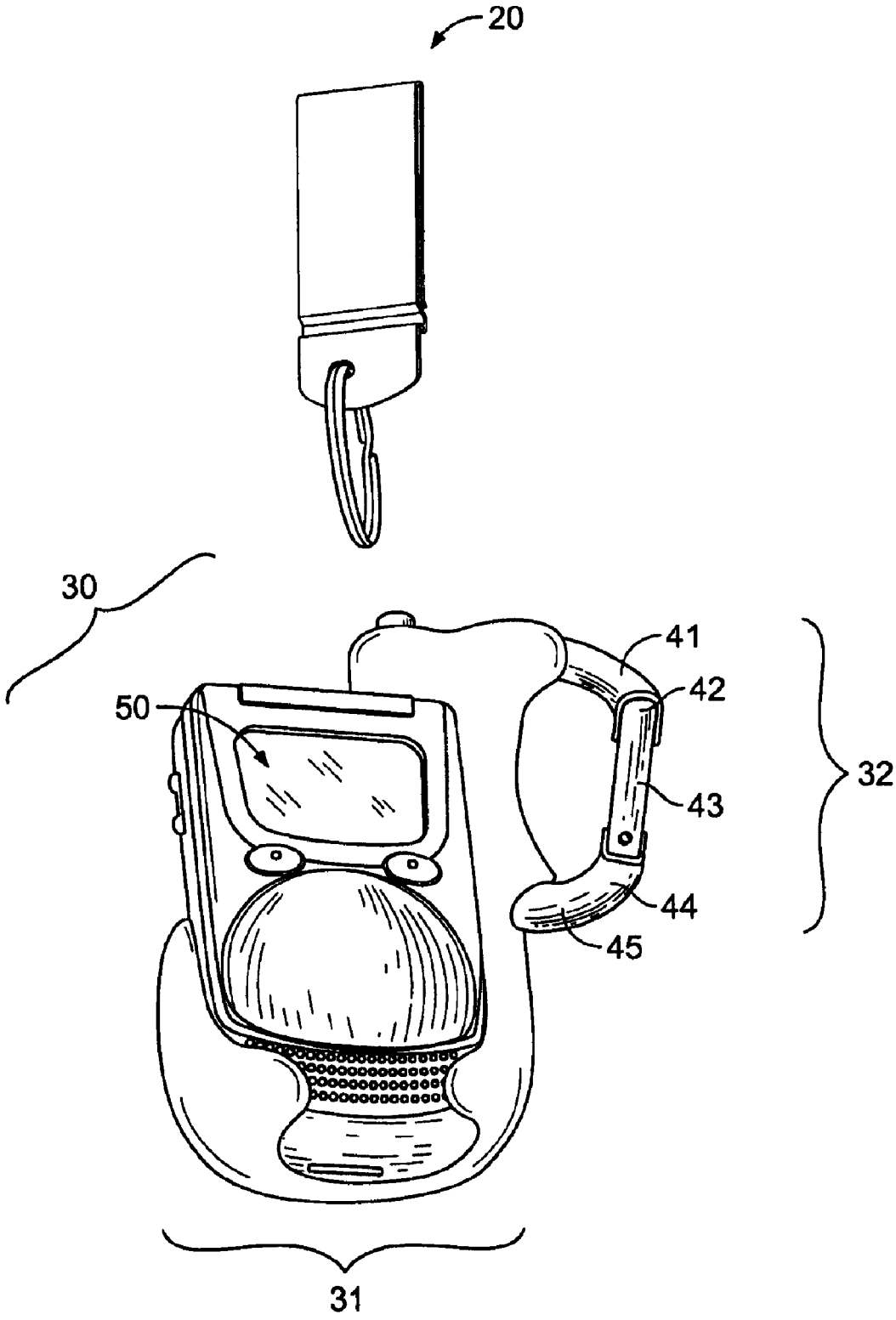
FIG. 2 is a plan view of a cellular phone secured within the cellular phone holder of FIG. 1.

In one embodiment of the latch 32, the latch would be made of a metal and secured to the molded plastic cradle 31. Alternatively, the latch 32 would be made of molded plastic. The cradle and the latch are made of a single, semi-flexible, molded plastic. A plastic latch and cradle would eliminate any potential electromagnetic interference for antenna signal reception that could occur by metal construction and could reduce cost. Referring to FIG. 2, the cell phone holder 30 has a cell phone 50 disposed in the cradle 31 of the cell phone holder 30. The clip 32 is spring-loaded clip shaped like a D-ring (also known as a carabiner). The clip 32 includes an upper portion 41 and a lower portion 45, and a central removable portion 43 which is pivotally attached to the lower portion 45 at a spring loaded joint 44. An upper portion of the central removable portion 34 engages an upper portion 41 of the clip 32 at a stop and guide member 42.

Another embodiment of the latch has threads on the central removable portion and the upper portion. A threaded member screws onto the latch which then can be tightened onto the upper portion securing the latch. The user would have to unscrew the nut in order to detach the cell phone holder 30 from the clip 20. This would be a little less desirable from the point of view of the user being able to rapidly get to the phone. However, it may be more desirable if the user prefers the addition protection against accidental release of the cell phone holder.

Figure 3:
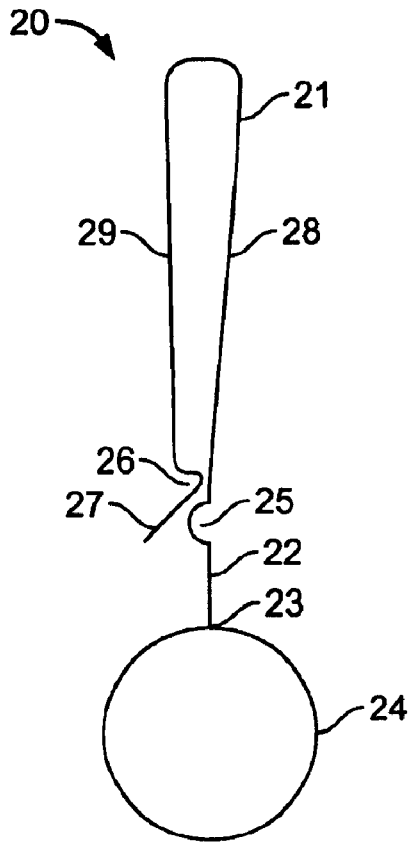
FIG. 3 is a side, plan view of a belt clip hanger clip.

Referring to FIG. 3, the belt hanger clip 20 has a clip 21 to fasten to a belt or other article of clothing of a user. A first flat surface 28 of the belt hanger clip 20 has a U-shaped recess 25. A second flat surface 29 of the belt hanger clip 20 has a V-shaped recess 26 that fits snugly against the top of the U-shaped recess 25. This allows the user to securely hang the belt hanger clip 20. The second flat surface 29 of the belt hanger clip 20 also has an outward extending surface 27 from the V-shaped recess 26 to allow the user to easily grip and remove the belt hanger clip 20. A loop member 24 in this embodiment is oriented vertically and the loop of the loop member 24 is disposed perpendicular to a plane formed by the flat surfaces 28 and 29. The loop member 24 is also rigidly fixed to the first surface 28 at attachment point 23 located near the end of flat surface 28. The loop 24 could be fastened, welded, spot welded, soldered, etc. to the first flat surface 28. The fixed loop 24 allows the user to quickly and effectively attach the carabiner style latch 32 to the loop 24 of belt hanger clip 20. The loop 24 need not be circular but can be any closed loop which provides positive attachment for latch 32 of cradle 31 (See FIG. 1). The U-shaped recess 25 is separated from the attachment point by member 22 of flat surface 28. Embodiments may have varying lengths for member 22. This allows varying clip lengths to accommodate easy attachment of the phone in various situations. For example, a longer clip length may be used when wearing a longer coat, a common occurrence in colder climates. Further embodiments may have allow attachment point 23 to be adjustable. By use of a setscrew and a track in member 22, the attachment point 23 can be moved up and down member 22. This allows customized vertical adjustment.

Figure 4:
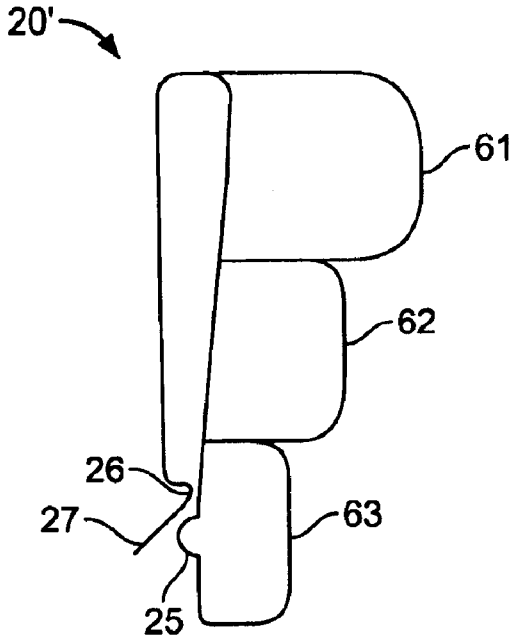
FIG. 4 is a further embodiment of the belt hanger clip.

Referring to FIG. 4, a further embodiment of belt hanger clip 20' would have multiply D-shaped loops replacing the single loop 24 of FIG. 3. The belt hanger clip 20' would have attached to one of the surfaces of the belt clip hanger an upper D-shaped loop 61, a middle D-shaped loop 62 and a lower D-shaped loop 63. The largest diameter D-shaped loop 61 would be located at the top and each successive D-shaped loop located downward would be successively smaller in diameter. Multiply, successively smaller loops allows the user to attach multiple objects to the belt hanger clip 20. In addition, this embodiment would allow the user to position the device on the holder as high or as low as desired, depending on the user's own comfort preference.

Figure 5:
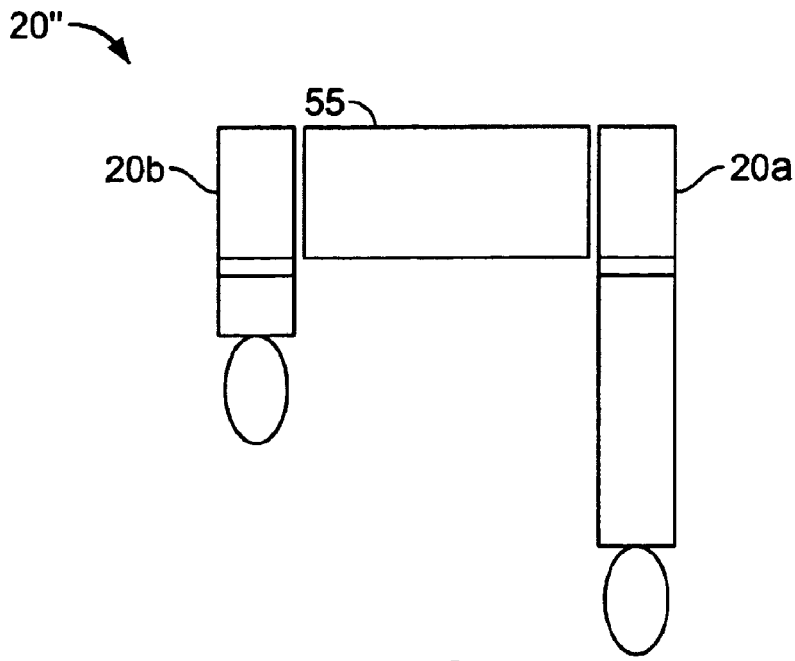
FIG. 5 is a further embodiment of the belt hanger clip.

Referring to FIG. 5, a further embodiment of belt hanger clip 20" would have multiple belt hanging clips 20 of FIG. 3. The multiple belt hanging clips 20*a* and 20*b* could be of varying length as shown in FIG. 5 and as described above in discussion of FIG. 3. The multiple belt hanger clips are kept apart by spacer 55. Spacer 55 may attach to the belt to kept clips 20*a* and 20*b* apart or spacer 55 may be rigidly attached to the clips 20*a* and/or 20*b*.

Figure 6:
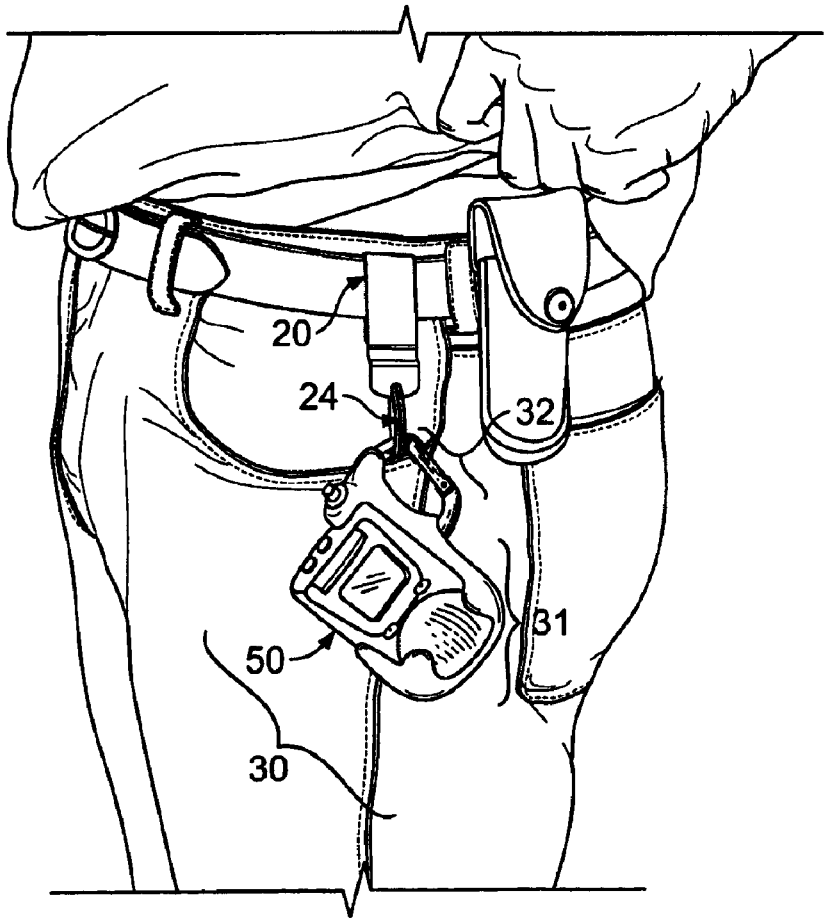
FIG. 6 is a view of a cellular phone holder of FIG. 1 attached to a belt hanger clip of FIG. 3 and secured to a user.

Referring to FIG. 6, a user is shown wearing the belt hanger clip 20 and having the cell phone holder 30 attached to the loop 24 of the belt hanger clip 20. The latch 32 hanging on the loop 24 supports the cradle 31 with the telephone 50. When the user needs to use the phone, the user will reach down, depress the movable member 43 and lift the cell phone holder 30 away from the clip. When a phone call is complete, the user sweeps the cell phone holder 30 down towards the user's side and quickly and securely latches the cell phone holder 30 to the belt hanger clip 20. An advantage of the cell phone holder assembly 10 is that if the user doesn't hear the latch open and close, the user knows the cell phone holder 30 has not been correctly secured to belt hanger clip 20.

Additionally, the holder can be adapted to house other portable device (e.g., Gameboy®, a camera, a radio, a Palmpilot®, etc.) . Accordingly, other embodiments are within the scope of the following claims.

What is claimed is:

1. A holder, comprises:

a cradle member for holding a portable electronic device having a column side support; and a D-shaped latch supported at one portion of the column, wherein the cradle and the latch are made of a single, semi-flexible, molded plastic.

2. The holder of claim 1 wherein the column side support is the first column support comprises:

a second column side support, a back support coupled between the first column side support the second column side support, and two bottom supports.

3. The holder of claim 1 wherein the column side support is the first column support and a second column side support is comprised of a material that is a more flexible material than material that forms the remainder of the cradle.

4. The holder of claim 1 wherein the latch is a spring-loaded, carabiner style latch.

5. The holder of claim 1 wherein the latch is a screw locking, carabiner style latch.

6. A holder assembly, comprises:

a belt hanger clip comprising:

a U-shaped clip portion having first and second flat surface;

a loop fixed vertically and perpendicular to the clip portion; and a cell phone holder portion comprising a cradle with a main column side; and support and a latch supported from by the main column coupled to the loop.

7. The holder assembly of claim 6 wherein said cradle comprises a second column side support, a back support, and two bottom supports.

8. The holder assembly of claim 7 wherein the second column side support is comprised of a material that is a more flexible material than material that forms the remainder of the cradle.

9. The holder assembly of claim 6 wherein the latch is a spring-loaded, carabiner style latch.

10. The holder assembly of claim 6 wherein the latch is a screw locking, carabiner style latch.

11. The holder assembly of claim 6 wherein the cradle and the latch are made of a single, semi-flexible, molded plastic.

12. The holder assembly of claim 6 wherein the cradle and the latch are made of different material and fixed together.

13. The holder assembly of claim 6 wherein said second flat surface has a V-shape recess arid said first flat surface has a U-shape recess wherein the V-shaped recess rests against the U shaped recess.

* * * * *